United States Patent [19]

Branovich et al.

[11] Patent Number: 4,818,480

[45] Date of Patent: Apr. 4, 1989

[54] METHOD OF MAKING A CATHODE FROM TUNGSTEN AND IRIDIUM POWDERS USING A BARIUM PEROXIDE CONTAINING MATERIAL AS THE IMPREGNANT

[75] Inventors: Louis E. Branovich, Howell Township, Monmouth County; Gerard L. Freeman, Freehold Township, Monmouth County; Bernard Smith, Ocean; Donald W. Eckart, Wall Township, Monmouth County, all of N.J.

[73] Assignee: The United States of America as represented by the Secretary of the Army, Washington, D.C.

[21] Appl. No.: 204,327

[22] Filed: Jun. 9, 1988

[51] Int. Cl.[4] ..... B22F 3/26

[52] U.S. Cl. ..... 419/27; 419/26; 419/28; 419/33; 419/38; 419/39; 419/54; 419/55; 419/58

[58] Field of Search ..... 419/33, 38, 39, 26, 419/28, 27, 54, 55, 58

[56] References Cited

U.S. PATENT DOCUMENTS

| | | | |
|---|---|---|---|
| 4,109,058 | 8/1978 | Love et al. | 419/35 |
| 4,126,451 | 11/1978 | Nayar | 419/8 |
| 4,179,289 | 12/1979 | Brandmair et al. | 419/38 |
| 4,444,718 | 4/1984 | Smith et al. | 419/2 |
| 4,767,372 | 8/1988 | Bossert et al. | 419/2 |

*Primary Examiner*—Stephen J. Lechert, Jr.
*Attorney, Agent, or Firm*—Sheldon Kanars; Roy E. Gordon

[57] ABSTRACT

A cathode is made from a mixture of tungsten and iridium powders using a barium peroxide containing material as the impregnant.

10 Claims, No Drawings

METHOD OF MAKING A CATHODE FROM TUNGSTEN AND IRIDIUM POWDERS USING A BARIUM PEROXIDE CONTAINING MATERIAL AS THE IMPREGNANT

The invention described herein may be manufactured, used and licensed by or for the Government for governmental purposes without the payment to us of any royalty thereon.

This invention relates in general to a method of making a long life high current density cathode and in particular, to a method of making such a cathode from a mixture of tungsten and iridium powders using a barium peroxide containing material as the impregnant.

BACKGROUND OF THE INVENTION

The state of the art as concerns the manufacture of long life high current density cathodes involves the initial mixing and heating of barium carbonate, $BaCO_3$ calcium carbonate, $CaCO_3$ and aluminum oxide, $Al_2O_3$. The $BaCO_3$ and $CaCO_3$ are decomposed at 1450° C. to form BaO and CaO which react with the $Al_2O_3$ to form aluminates. The aluminates are then impregnated into a porous billet of tungsten or tungsten and iridium or tungsten and osmium, or tungsten and rhodium, etc. heated in a cathode environment, and testing made. The process involves the decomposition of the aluminates to form the barium iridiates, barium osmiates and barium rhodiates.

SUMMARY OF THE INVENTION

The general object of this invention is to provide an improved method of making a long life high density cathode. A more specific object of this invention is to provide such a method in which the intermediate formation of aluminates is obviated and in which lower temperatures can be used.

It has now been found that the aforementioned objects can be attained by a method that uses a barium peroxide containing material as the impregnant. Such material can be barium peroxide alone, or a mixture of barium peroxide with iridium, or a mixture of barium peroxide with osmium, or a mixture of barium peroxide with rhodium.

More particulary, according to the invention, a suitable porous billet of tungsten, or tungsten iridium, or tungsten-osmium or tungsten-rhodium is impregnated with a barium peroxide containing material in a hydrogen atmosphere and slowly heated to above 800° C. to decompose the barium peroxide, $BaO_2$ to form barium oxide, BaO, and oxygen $O_2$ according to the reaction:

$$2BaO_2 \rightarrow 2BaO + O_2$$

The sample BaO reacts with the tungsten wall of the billet or the tungsten-rhodium wall of the billet to form the desired oxyanion. The heating of the billet with the impregnant is complete when the impregnant is solidified. The impregnant solidifies when the temperature is raised slowly above 800° C. or by rapid heating above 800° C. The slower process of heating above 800° C. allows the impregnant more time to react.

After the reaction is complete, the sample is removed and the system flushed with nitrogen. The material that did not enter into the pores of the billet is removed using a jeweler's lathe and the billet then placed into a cathode environment for electrical testing of current density emissions and life studies.

DESCRIPTION OF THE PREFERRED EMBODIMENT

A long life high current density cathode is made in the following manner. Tungsten and iridium powders are mixed in a weight ratio of about 65 weight percent tungsten to about 34 weight percent iridium. 1 percent by weight of zirconium hydride activator is added to the mixture and the mixture ball milled for about 8 hours. The ball milled mixture is then pressed into a billet at about 48,000 p.s.i. in a die and the billet then sintered at 1800° C. for thirty minutes in dry hydrogen of less than −100 dewpoint. The billet is then backfilled with copper in dry hydrogen at 1500° C., the billet machined to the desired geometry, and the copper then removed by etching in nitric acid. The porous billet is then thoroughly rinsed in deionized water, methanol and then dried. The billet is then impregnated with barium peroxide by slowly heating to above 800° C. for about two minutes. The billet is removed from the furnace after the furnace is cooled and loose particles of impregnant are removed from the billet using a jeweler's lathe and fine alumina cloth.

The resulting cathode is then mounted in a test vehicle and activated using standard matrix cathode activation procedures.

When the impregnant is barium peroxide mixed with iridium or osmium or rhodium or ruthenium, molar ratios will vary depending upon how long the reaction is run.

We wish it to be understood that we do not desire to be limited to the exact details of construction as described for obvious modifications will occur to a person skilled in the art.

What is claimed is:

1. Method of making a cathode for operation in microwave devices from tungsten and iridium powders using a barium peroxide containing material as the impregnant, said method including the steps of:

(A) mixing the tungsten and iridium powders,
(B) adding about 2 percent by weight of an activator to the mixture,
(C) ball milling the mixture for about 8 hours,
(D) pressing the ball milled mixture into a billet at about 48,000 p.s.i. in a die,
(E) sintering the billet at about 1800° C. for about thirty minutes in dry hydrogen of less than −100 dewpoint,
(F) backfilling the billet with copper in dry hydrogen at about 1500° C.,
(G) machining the billet to the desired geometry,
(H) removing the copper by etching in nitric acid,
(I) thoroughly rinsing in deionized water, methanol and then drying,
(J) firing the billet in dry hydrogen at about 1400° C. for about 15 minutes,
(K) impregnating the billet with a barium peroxide containing material by firing the billet in a dry hydrogen furnace at a temperature at which the impregnant melts for about two minutes,
(L) removing the billet from the furnace after the furnace is cooled, and
(M) removing any loose pieces of impregnant from the billet.

2. Method of making a long life high current density cathode according to claim 1 wherein in step (A), the tungsten and iridium powders are mixed in a weight ratio of about 65 weight percent tungsten to about 34 weight percent iridium.

3. Method of making a cathode according to claim 1 wherein in step (B), the activator is about 1 weight percent zirconium hydride.

4. Method of making a cathode according to claim 1 wherein in step (K), the barium peroxide containing material is selected from the group consisting of barium peroxide, a mixture of barium peroxide with iridium, a mixture of barium peroxide with osmium, a mixture of barium peroxide with rhodium, and a mixture of barium peroxide with ruthenium.

5. Method of making a cathode according to claim 4 wherein in step (K), the barium peroxide containing material is barium peroxide.

6. Method of making a cathode according to claim 4 wherein in step (K), the barium peroxide containing material is a mixture of barium peroxide with iridium.

7. Method of making a cathode according to claim 4 wherein in step (K), the barium peroxide containing material is a mixture of barium peroxide with osmium.

8. Method of making a cathode according to claim 4 wherein in step (K), the barium peroxide containing material is a mixture of barium peroxide with rhodium.

9. Method of making a cathode according to claim 4 wherein in step (K), the barium peroxide containing material is a mixture of barium peroxide with ruthenium.

10. Method of making a cathode for operation in microwave devices from tungsten and iridium powders using barium peroxide as the impregnant, said method including the steps of:

(A) mixing the tungsten and iridium powders in the weight ratio of about 65 weight percent tungsten to about 34 weight percent iridium, (B) adding about 1 percent by weight of zirconium hydride to the mixture, (C) ball milling the mixture for about 8 hours, (D) pressing the ball milled mixture into a billet at about 48,000 p.s.i. in a die, (E) sintering the billet at about 1800° C. for about thirty minutes in dry hydrogen of less than −100 dewpoint, (F) back filling the billet with copper in dry hydrogen at about 1150° C., (G) machining the billet to the desired geometry (H) removing the copper by etching in nitric acid, (I) thoroughly rinsing in deionized water, methanol and then drying, (J) firing the billet in dry hydrogen at about 1400° C. for about 15 minutes, (K) impregnating the billet with the barium peroxide by firing the billet in a dry hydrogen furnace at about 800° C. for about two minutes, (L) removing the billet from the furnace after the furnace is cooled, and (M) removing any loose pieces of impregnant from the billet.

* * * * *